United States Patent [19]

Van Buren

[11] Patent Number: 4,845,404

[45] Date of Patent: Jul. 4, 1989

[54] PROJECTION TUBE PANEL FUNNEL SPRING CONTACTOR AND PROJECTION TUBE EMPLOYING SAME

[75] Inventor: Gerald E. Van Buren, Geneva, N.Y.

[73] Assignee: North American Philips Corporation, New York, N.Y.

[21] Appl. No.: 175,451

[22] Filed: Mar. 30, 1988

[51] Int. Cl.[4] ..... H01J 29/90; H01R 4/48

[52] U.S. Cl. ..... 313/477 HC; 439/834

[58] Field of Search ..... 313/477 R, 477 HC; 439/346, 350, 611, 817, 834, 861, 883

[56] References Cited

U.S. PATENT DOCUMENTS 4,230,966 10/1980 Compen ..... 313/477 HC X 4,333,033 6/1982 Cordingley et al. .... 313/477 HC X

*Primary Examiner*—Kenneth Wieder

*Attorney, Agent, or Firm*—John C. Fox

[57] ABSTRACT

A panel-funnel spring contactor for a projection tube features a keyhole for mechanical engagement with a stud standing on the anode button. Instead of relying upon a leg extending onto the funnel coating to press the contactor against a retaining head on the stud, the present design rolls the leg under the keyhole and extends the keyhole slot into the leg to allow the leg to rest against the upper surface of the anode button and bias the contactor upward against the retaining head.

32 Claims, 2 Drawing Sheets

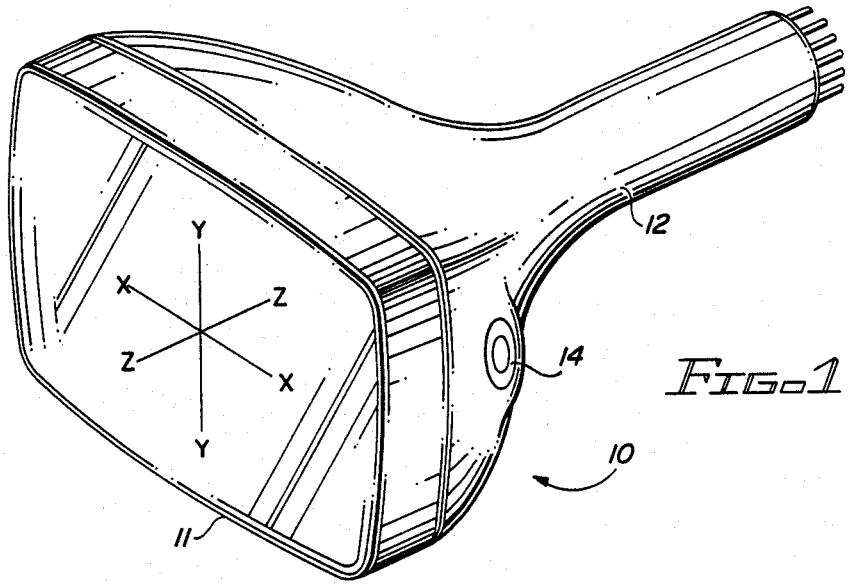
FIG. 1
FIG. 2
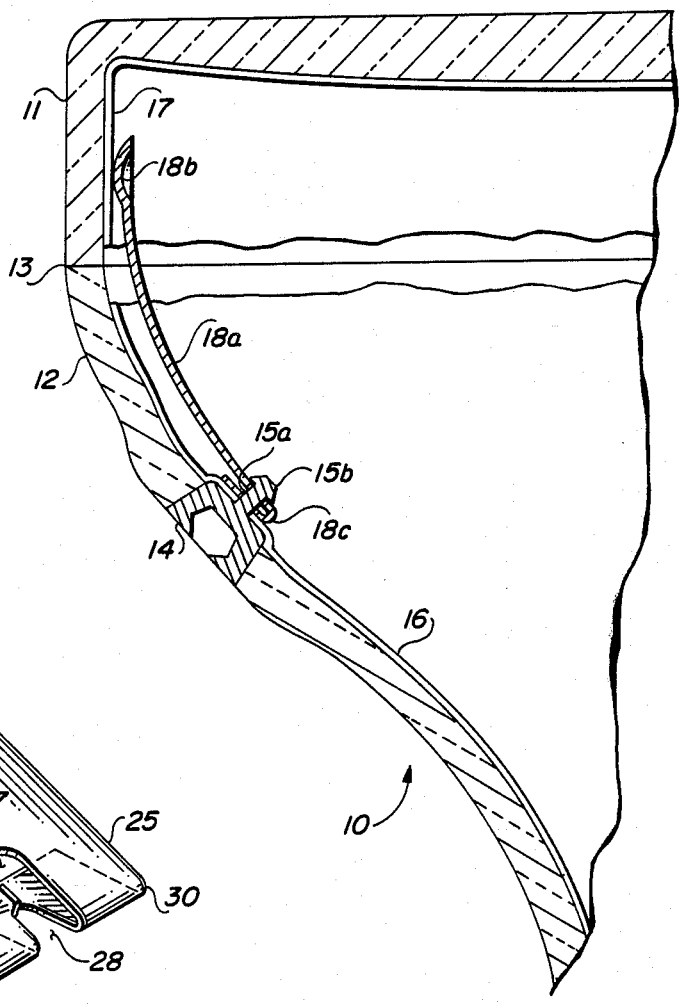
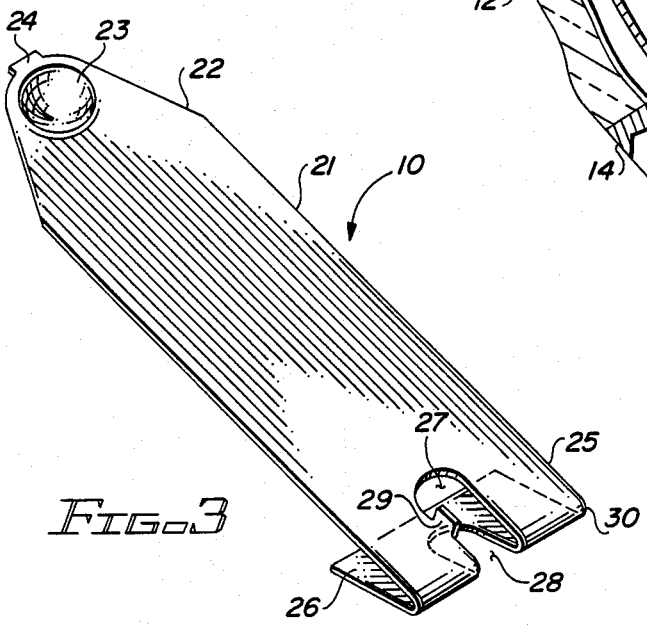
FIG. 3

PROJECTION TUBE PANEL FUNNEL SPRING CONTACTOR AND PROJECTION TUBE EMPLOYING SAME

BACKGROUND OF THE INVENTION

This invention relates to cathode ray tubes for projection television, and more particularly relates to a spring contactor for electrically bridging the frit seal between the panel and funnel portions, and also relates to a projection tube employing such a spring contactor.

Commercial color television projection systems in general rely upon the superimposing of three different video images on the projection screen, each image in one of the primary colors red, blue or green, in order to reproduce a full color video image. In such a system the video signals for each of the primary colors are fed to separate monochrome cathode ray tubes whose display screens are each comprised of a phosphor emitting in one of the primary colors. The monochrome video images formed on the tube display screens are then projected through suitable projection optics onto the rear surface of a rear projection screen for display to an audience.

In such color television projection systems a number of problems occur. For example, the projection of a flat display on a flat projection screen requires a complicated system of lenses, 5 to 8 element lenses typically being necessary for optical quality. Moreover, despite such complex lens systems, a brightness decline of approximately 20 percent generally occurs from the center to the corners of the projection screen. In addition, the overall brightness of the projection screen is generally less than desired. Choosing phosphors based on their superior brightnesses of emission has unfortunately resulted in other problems, such as inferior color rendition and chromatic abberation.

By providing the projection television display tubes with a curved display screen including a multi-layer intereference filter, these problems are solved for the greater part. See for example U.S. Pat. No. 4,683,398, issued July 28, 1987 to Vriens et al. For ease of manufacturing, such tubes are produced in two parts, a face panel and a funnel, which parts are frit sealed together in a manner similar to the conventional frit sealing of color cathode ray tubes for direct view color television. Such a two-part construction enables easier fabrication of a face panel having the necessary curvature and interference filter.

Subsequent to formation of the interference filter on the curved display screen surface, a monochrome phosphor layer is deposited on the filter, such as by settling of phosphor particles from a slurry. Following deposition of the phosphor layer, a thin evaporated aluminum layer is formed over the phosphor layer in the conventional manner.

In order to provide anode potential to the screen, electrical contact must be provided between the aluminum layer and the anode button located in the sidewall of the funnel portion of the tube. In FIG. 2 of British Pat. No. 2,075,748, a projection tube is shown in which the necessary electrical contact is provided by a spring contactor 15, having one end attached to the anode button 14 and the other end free to resiliently contact conductive layer 13 (e.g., evaporated aluminum) on the inner surface of the panel 12.

Problems encountered in attaching the spring contactor to the anode button include the production of loose particles, a notorious source of defects in such high voltage cathode ray tubes. Such loose particles can, for example, become lodged on parts of the high voltage electron gun, causing shorting and/or arcing.

One source of particles is weld splatter occurring during the welding of the contactor to the anode button. In order to avoid this problem, it has been proposed to mechanically attach the contactor to the anode button. One means for mechanical attachment is shown in U.S. Pat. No. 4,230,966, issued Oct. 28, 1980, to J. Compen. In this patent, a contactor comprises an elongated strip of spring material, having a U-shaped portion at each end of the strip for making slidable contact with the interior conductive coating of the funnel and having a keyhole-shaped aperture in the middle of the strip which may be slidably engaged with a stud upstanding on the anode button. During insertion and attachment of the strip to the anode, the strip is downwardly flexed to engage the anode button stud in the large portion of the aperture, and then laterally slide the strip along the internal coating until the stud is secured in the small portion of the aperture.

A similar arrangement when tried in a projection cathode ray tube was found to produce loose particles through the frictional engagement of the contact member with the internal coating during insertion and engagement with the anode button stud, due to the necessity for downward flexing of the spring member against the coating while at the same time laterally sliding the member in order to engage the stud.

Accordingly, it is an object of the invention to provide an internal spring contactor for a projection cathode ray tube which may be conveniently mechanically attached to the stud of an anode button while substantially avoiding frictional contact with the internal conductive coating on the funnel of the tube.

SUMMARY OF THE INVENTION

In accordance with the invention, there is provided a projection tube panel-funnel spring contactor having a keyhole-shaped aperture for mechanical engagement of the contactor with the stud of an anode button, the contactor characterized by having a leg extending under the keyhole region and having an aperture aligned with and communicating with the keyhole-shaped aperture so that during engagement of the contactor with the stud, the leg contacts substantially only the base portion of the anode button surrounding the stud, thereby substantially avoiding frictional contact of the contactor with the funnel coating.

In accordance with a preferred embodiment of the invention, locking engagement of the contactor with the stud is enhanced by at least one upstanding tab near the entry to the locking portion of the aperture.

BRIEF DESCRIPTION OF THE DRAWING

FIG. 1 is a perspective view of a two-part projection cathode ray tube of the invention, including a penal and funnel;

FIG. 2 is a section view of a portion of the tube of FIG. 1 taken along the X-Z plane, showing an internal panel-funnel spring contactor of the invention;

FIG. 3 is a perspective view of one embodiment of the spring contactor of FIG. 2;

DESCRIPTION OF THE PREFERRED EMBODIMENTS

Figure 4:
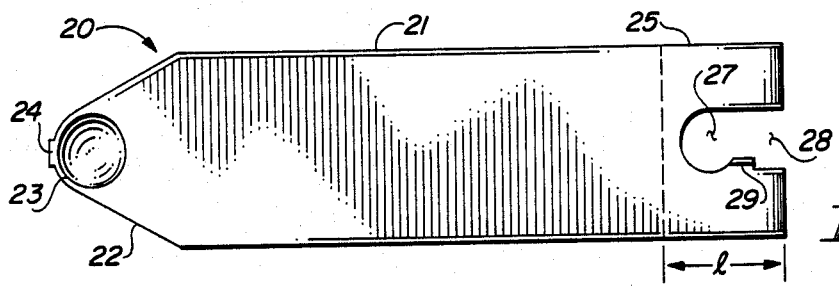
FIG. 4 is a plan view of the contactor of FIG. 3.

Referring to FIG. 1, there is shown a projection cathode ray tube 10 comprised of a glass face panel portion 11, frit sealed to a glass funnel portion 12. The funnel portion 12 includes a metal anode button 14 sealed into the sidewall of the funnel. The tube is oriented three dimensionally with respect to X, Y and Z axes as indicated on the face of the panel.

Referring to FIG. 2, there is shown a section view taken along the plane X-Z of a portion of the tube of FIG. 1, showing panel 11 frit sealed to funnel 12 by a frit layer 13, anode button 14 sealed into the glass wall of the funnel 12 and having an upstanding stud on the upper base portion of the button, the stud 15 comprised of a neck 15*a* and a head 15*b*. Coated on the interior surface of funnel 12 is conductive coating 16, and formed on the inner surface of panel 11 is conductive layer 17 (which overlies phosphor and interference layers, not shown). Electrically connecting the anode button 14 in the funnel 12 to the conductive layer 17 in the panel 11 is spring contactor 18, including a body portion 18*a*, a contact portion 18*b*, making firm electrical contact with layer 17 by virtue of the outward spring bias of the contactor 18, and locking portion 18*c* for making mechanical and electrical connection with the stud 15 of the anode button 14.

The preferred method of assembling the tube parts is to first forming a bead of frit 13 along the edge of funnel 12, followed by engagement and locking of spring contactor 18 onto stud 15 of anode button 14, followed by placement of face panel 11 onto the frit seal bead, resulting in contact with inward flexing of contactor 18, and finally fixturing and heat treating the assembly at a temperature to result in frit sealing of the panel and funnel members, typically about 450° C.

Figure 5:
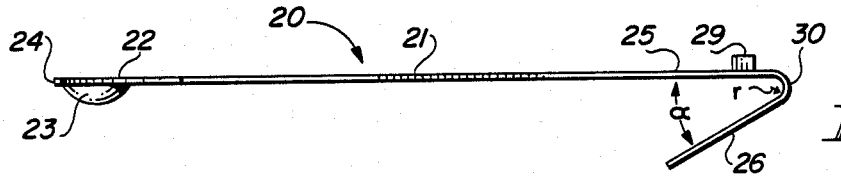
FIG. 5 is a side elevation view of the contactor of FIG. 3.

FIG. 3 is a perspective view of one embodiment of the spring contactor of the invention prior to insertion into the funnel and engagement with the anode button stud. FIGS. 4 and 5 are a plan view and a side elevation view respectively of the spring contactor of FIG. 3. The contactor 20 comprises a body portion 21 and end portions 22 and 25. Portion 22 tapers to a narrower width than body portion 21 to terminate in a spherical contact portion 23, having a concave curvature in the view shown. Pinch-off tab 24 is a remnant of the forming operation and neither contributes to nor detracts from the functionality of the device. The other, locking end 25 of the spring contactor connects to a leg portion 26 by means of a transverse bend 30 having an appreciable radius of curvature, for example, about 5 to 20 percent of the length 1 of leg 26. Leg 26 preferably forms an angle $\alpha$ with the body 21 of about 20 to 30 degrees, so that upon subsequent insertion and engagement of the spring contactor 20 with the anode button stud, leg 26 becomes flexed and, due to the spring properties of the material from which the contactor is fabricated, upwardly biases end portion 25 against the head 15*b* of the stud. Such engagement is enabled by circular aperture 27 in the locking end 25 of the spring contactor and slot 28 communicating with aperture 27, extending around bend 30 and part way into the leg 26, to terminate at a position in approximate vertical alignment with aperture 27. Circular aperture 27 and slot 28 collectively constitute what is sometimes referred to herein as the keyhole-shaped aperture.

An upstanding locking tab 29 is preferably provided in the transition region between circular aperture 27 and slot 28, in order to further assure a secure locking engagement of spring contactor 20 with stud 15.

A principal advantage of the invention is that during the downward flexing of the contactor 20 in order to achieve upward flexing of leg 26 and engagement of stud 15 in aperture 27, leg 26 makes sliding contact with the anode button surface surrounding stud 14. This surface, being electrically conductive itself, need only be peripherally contacted with conductive layer 16, so that sliding contact with the coating during insertion and engagement may be substantially completely avoided, considerably reducing the chance of producing loose particles during assembly.

An exemplary spring contactor for a 7" projection tube is fabricated from 304 stainless steel in a half hard condition, and has an overall length of about 2 inches, a length 1 of leg 26 of about 0.4 inches, a radius of bend 30 of about 0.04 inches, and an angle $\alpha$ of about 25 degrees.

Figure 6:
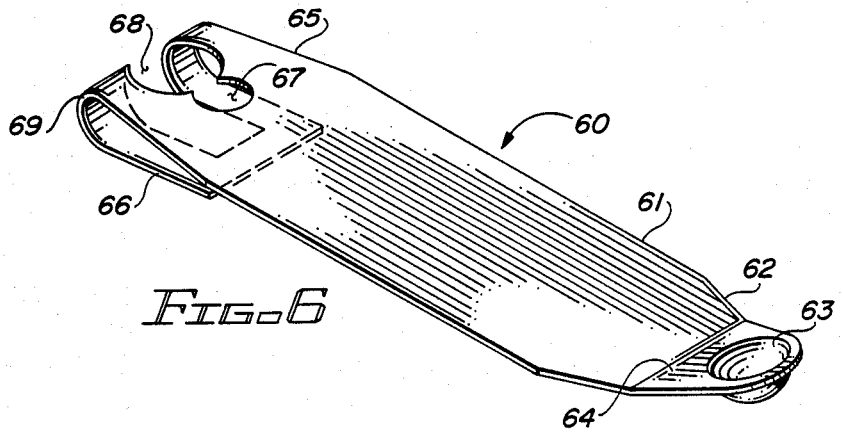
FIG. 6 is a perspective view of another embodiment of the spring contactor of the invention.

Referring now to FIG. 6, there is shown another embodiment of the spring contactor of the invention, which is similar to spring contactor 20 of FIGS. 3 through 5, except that the slot 68 in the region between aperture 67 and transverse bend 69 has been widened into a circular shape to provide additional clearance for the head 15*b* of the stud during insertion and engagement. In addition, the locking end 65 of the spring contactor tapers inwardly toward the aperture, resulting in a narrower width for leg 66 than for body 61. This narrower width provides further assurance that sliding engagement during insertion and locking is confined substantially to the upper base surface of the anode button 14. At the other contact end 62, also tapered, a transverse bend 64 tangent to the concave spherical contact portion 63, inclines contact portion 63 at a moderate angle relative to body portion 61 in order to result in moderation of the contact pressure on layer 17 on the face panel skirt.

Figure 7:
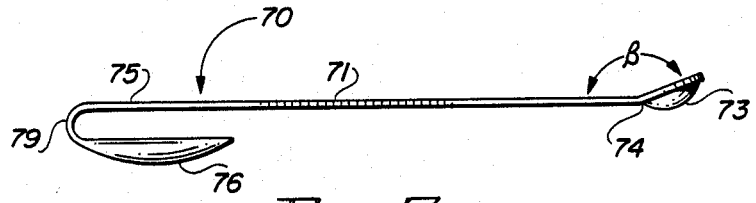
FIG. 7 is a side elevation view of yet another embodiment of the spring contactor of the invention.

Referring now to FIG. 7, there is shown a further embodiment of the invention in which contact spring 70 has a leg 76 which is dish-shaped, in order to further reduce the contact area between the leg and the upper surface of anode button 14 during engagement and locking of the spring contact or the stud 15. Spherical contact portion 73 is adjoined to body 71 by a transverse bend 74 at an angle $\beta$ which may be, for example, 140 to 160 degrees.

Figure 8:
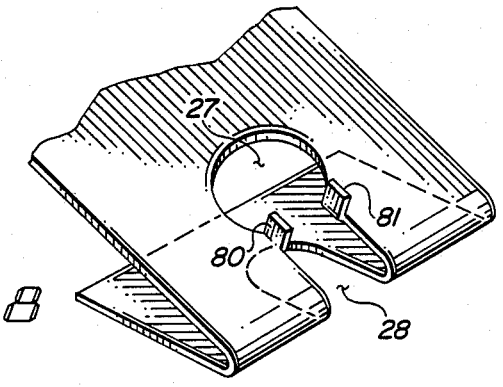
FIG. 8 is a partial perspective view of still another embodiment of the spring contactor of the invention.

Referring now to FIG. 8, there is shown a modification of the spring contactor 20 of FIGS. 3 through 5, in which the single upstanding locking tab 29 is replaced by a pair of such locking tab 80 and 81 facing each other in the transition region between the aperture 27 and slot 28.

Other variations will become apparent to those skilled in the art and are intended to be included within the scope of the invention. For example, slot 28 may extend completely through the leg, bifurcating the leg. Also, a getter may be mounted on the spring contactor, for example on the body portion near the locking end 25, or on a cantilevered extension from locking portion 25. Where the getter material is "non-bakable", that is, unable to withstand the temperatures encountered during frit sealing of the panel to the funnel of the tube, the contactor can be installed through the open neck portion subsequent to frit sealing, using an insertion tool.

What is claimed is:

1. A panel-funnel spring contactor for mechanical engagement with the stud portion of an anode button of the funnel of a cathode ray tube, and for spring-biased contact with the panel of the cathode ray tube, the contactor comprising: a body portion and first and second end portions having upper and lower surfaces; the first end portion defining a first aperture for allowing sliding engagement of the spring contactor with the stud of the anode button, and a second aperture communicating with the first aperture for providing locking engagement of the spring contactor with the stud; and the second end portion comprising a contact portion outwardly curving from the lower surface of the end portion, characterized in that the contactor includes a leg portion adjacent the lower surface of the first end portion, and in that the leg portion is attached to the end portion by a transverse bend region, and extends beyond the second aperture, and in that the first aperture extends through the transverse bend region and into the leg portion to a position at least below the second aperture.

2. The spring contactor of claim 1 in which the first aperture is slot-shaped and the second aperture is circular.

3. The spring contactor of claim 2 in which the slot-shaped aperture is outwardly curved in the region between the second aperture and the transverse bend region.

4. The spring contactor of claim 3 in which at least one upstanding locking tab is located in a transition region between the first and second apertures.

5. The spring contactor of claim 4 in which the first end portion tapers inwardly toward the apertures to define a width of the transverse bend region and leg portion which are narrower than the width of the body portion.

6. The spring contactor of claim 5 in which at least a portion of the periphery of the leg portion is curved upward.

7. The spring contactor of claim 6 in which the leg portion is substantially bowl-shaped.

8. The spring contactor of claim 1 in which the contact portion in the second end portion is spherically shaped.

9. The spring contactor of claim 8 in which the second end portion contains a transverse bend, forming an angle between the body portion and the second end portion.

10. The spring contactor of claim 9 in which the angle is from about 140° to 160°.

11. The spring contactor of claim 1 in which the leg portion forms an angle with the body portion of the contactor.

12. The spring contactor of claim 11 in which the angle is from about 20° to 30°.

13. The spring contactor of claim 1 in which the transverse bend region between the first end portion and the leg portion has a radius of curvature.

14. The spring contactor of claim 13 in which the radius is about 5 to 20 percent of the length of the leg portion.

15. The spring contactor of claim 1 in which a getter is attached to the body of the contactor.

16. The spring contactor of claim 1 in which the first aperture extends completely through the leg portion to bifurcate the leg portion.

17. A cathode ray tube comprising: a panel portion and a funnel portion joined by a frit seal; an anode button including a stud upstanding from an upper base of the anode button; the stud including a neck and a head sealed into the sidewall of the funnel portion; conductive coatings on the interior surfaces of the funnel and panel portions; and a spring contactor electrically connecting the conductive coatings of the panel and funnel portions; the spring contactor comprising a body portion and first and second end portions having upper and lower surfaces, the first end portion defining a first aperture for allowing sliding engagement of the spring contactor with the stud of the anode button, and a second aperture communicating with the first aperture for providing locking engagement of the spring contactor with the stud; and the second end portion comprising a contact portion outwardly curving from the lower surface of the end portion, characterized in that the contactor includes a leg portion adjacent the lower surface of the first end portion, and in that the leg portion is attached to the end portion by a transverse bend region, and extends beyond the second aperture, and in that the first aperture extends through the transition region and into the leg portion to a position below the second aperture, the leg portion rests on the upper base of the anode button and upwardly biases the first end portion against the head of the stud.

18. The cathode ray tube of claim 17 in which the first aperture is slot-shaped and the second aperture is circular.

19. The cathode ray tube of claim 18 in which the slot-shaped aperture is outwardly curved in the region between the second aperture and the transverse bend region.

20. The cathode ray tube of claim 19 in which at least one upstanding locking tab is located in a transition region between the first and second apertures.

21. The cathode ray tube of claim 20 in which the first end portion tapers inwardly toward the apertures to define a width of the transverse bend region and leg portion which are narrower than the width of the body portion of the spring contactor.

22. The cathode ray tube of claim 21 in which at least a portion of the periphery of the leg portion is curved upward.

23. The cathode ray tube of claim 22 in which the leg portion is substantially bowl-shaped.

24. The cathode ray tube of claim 17 in which the contact portion in the second end is spherically shaped.

25. The cathode ray tube of claim 24 in which the second end contains a transverse bend, forming an angle between the body portion and the second end portion.

26. The cathode ray tube of claim 25 in which the angle is from about 140° to 160°.

27. The cathode ray tube of claim 17 in which the leg portion forms an angle with the body portion of the contactor.

28. The cathode ray tube of claim 27 in which the angle is from about 20° to 30°.

29. The cathode ray tube of claim 17 in which the transverse bend region between the first end portion and the leg portion has a radius of curvature.

30. The cathode ray tube of claim 29 in which the radius is about 5 to 20 percent of the length of the leg portion.

31. The cathode ray tube of claim 17 in which a getter is attached to the body of the contactor.

32. The cathode ray tube of claim 17 in which the first aperture extends completely through the leg portion to bifurcate the leg portion.

* * * * *